US010753024B2

(12) United States Patent
Hillenbrand

(10) Patent No.: US 10,753,024 B2
(45) Date of Patent: Aug. 25, 2020

(54) SEWING MACHINE NEEDLE, METHOD FOR PRODUCING A SEWING MACHINE NEEDLE, AND SEWING METHOD

(71) Applicant: Groz-Beckert KG, Albstadt (DE)

(72) Inventor: Bernd Eugen Hillenbrand, Truchtelfingen (DE)

(73) Assignee: Groz-Beckert KG, Albstadt (DE)

( * ) Notice: Subject to any disclaimer, the term of this patent is extended or adjusted under 35 U.S.C. 154(b) by 95 days.

(21) Appl. No.: 15/767,097

(22) PCT Filed: Sep. 16, 2016

(86) PCT No.: PCT/EP2016/071998
§ 371 (c)(1),
(2) Date: Apr. 9, 2018

(87) PCT Pub. No.: WO2017/060056
PCT Pub. Date: Apr. 13, 2017

(65) Prior Publication Data

US 2018/0291542 A1 Oct. 11, 2018

(30) Foreign Application Priority Data

Oct. 8, 2015 (EP) ..... 15188948

(51) Int. Cl.
*D05B 85/02* (2006.01)
*D05B 85/00* (2006.01)

(52) U.S. Cl.
CPC ..... *D05B 85/02* (2013.01); *D05B 85/00* (2013.01)

(58) Field of Classification Search
CPC ..... D05B 5/02; D05B 5/00
(Continued)

(56) References Cited

U.S. PATENT DOCUMENTS 3,589,428 A 6/1971 Masujima
4,458,614 A 7/1984 Iwashita
(Continued)

FOREIGN PATENT DOCUMENTS

CN 1080674 A 1/1994
CN 100519877 C 7/2009
(Continued)

OTHER PUBLICATIONS

Taiwanese First Office Action dated Sep. 3, 2019, in corresponding Taiwanese Application No. 105132297, with machine English translation (6 pages).
(Continued)

*Primary Examiner* — Clinton T Ostrup
*Assistant Examiner* — Patrick J. Lynch
(74) *Attorney, Agent, or Firm* — Fitch, Even, Tabin & Flannery LLP

(57) ABSTRACT

A sewing machine needle includes a blade extending substantially in the needle's longitudinal direction, an eye, which passes through the needle substantially in its elevational direction, and a scarf, which extends along the needle behind the eye. Compared with the contour of the blade, the scarf contour is recessed in the needle's elevational direction. At least in part of the scarf's extension along the needle, the scarf contour in a sectional plane perpendicular to the needle's longitudinal direction is substantially an arc of a circle. The circular-arc-shaped area covers a first angular portion of the needle's circumference. In this part of the scarf's extension along the needle, the radius of the substantially circular-arc-shaped contour in this first angular portion of the needle's circumference is between 35% and 100% of the needle's maximum lateral reach. The needle's lateral direction is perpendicular to its longitudinal and elevational directions.

11 Claims, 2 Drawing Sheets

(58) Field of Classification Search
USPC ..... 28/115; 606/222, 223; 223/102; 112/222
See application file for complete search history.

(56) References Cited

U.S. PATENT DOCUMENTS

| | | | | |
|---|---|---|---|---|
| 5,392,725 | A | 2/1995 | Takei et al. | |
| 6,318,280 | B1 | 11/2001 | Vornholt | |
| 6,332,417 | B1 | 12/2001 | Vornholt | |
| 6,986,315 | B2 * | 1/2006 | Toya | D05B 85/00 112/222 |
| 2006/0112867 | A1 * | 6/2006 | Weinberg | D05B 85/02 112/222 |
| 2007/0193487 | A1 * | 8/2007 | Hillenbrand | D05C 15/20 112/80.16 |

FOREIGN PATENT DOCUMENTS

| | | | | |
|---|---|---|---|---|
| DE | 3027534 | A1 | 2/1982 | |
| DE | 10026576 | A1 * | 12/2001 | D05B 85/00 |
| DE | 69220550 | T3 | 11/2004 | |
| EP | 1052323 | A2 | 11/2000 | |
| EP | 1052324 | A2 | 11/2000 | |
| TW | 200404932 | A | 4/2004 | |

OTHER PUBLICATIONS

Extended European Search Report in corresponding International Application No. PCT/EP2016/071998, dated Dec. 3, 2015, 7 pages.
International Search Report in corresponding International Application No. PCT/EP2016/071998, dated Nov. 16, 2016, 12 pages.
First office action in Government of the People's Republic of Bangladesh Application No. BD/P/2016/231/3174, dated Nov. 27, 2017, 1 page.
International Preliminary Report on Patentability in corresponding Application No. PCT/EP216/071998, dated Dec. 18, 2017, 4 pages.
Brazilian Office Action dated Jan. 10, 2020, in corresponding Brazilian Application No. BR112018006708-3, with English translation (5 pages).
Chinese First Office Action and Search Report dated Feb. 3, 2020, in corresponding Chinese Application No. 201680058199.0, with English translation (22 pages).
Indonesian Office Action dated Jun. 12, 2020, in corresponding Indonesian Application No. P00201802558, with machine English translation (5 pages).

* cited by examiner

SEWING MACHINE NEEDLE, METHOD FOR PRODUCING A SEWING MACHINE NEEDLE, AND SEWING METHOD

CROSS REFERENCE TO RELATED APPLICATIONS

This patent application is the national phase of PCT/EP2016/071998 filed Sep. 16, 2016, which claims the benefit of European Patent Application No. 15188948.2 filed Oct. 8, 2015.

TECHNICAL FIELD

The invention relates to a sewing machine needle, to a method for the manufacture of a sewing machine needle and a sewing method. Various different types of sewing machine needles, methods for the manufacture of a sewing machine needle and sewing methods are known.

BACKGROUND

The DE69220550T3 discloses a manufacturing method for a sewing machine needle with a reduced scarf width. The width of the scarf is particularly smaller than the height of the scarf. The intention is for the needle to encounter less penetration resistance.

EP1052324A2 discloses a flat scarf that is rounded to avoid sharp edges of the scarf damaging the fabrics to be sewn. Thus, the cross-sectional contour of the scarf nearby the center portion of the scarf is not rounded at all or at least has a very big radius of curvature. Near to the edges of the scarf the radius is very small. As a consequence there are broad side faces parallel to a line 9 in the direction as the eye of the needle.

U.S. Pat. No. 3,589,428A discloses a method for the manufacture of a sewing machine needle forming a flat section in advance of forming a longitudinal groove. The sewing machine needle has no scarf.

DE3027534A1 discloses a sewing machine needle with a scarf displaced parallel to the rest of the blade. The displaced scarf offers enlarged space between the thread and the needle. Thus, picking of the loop is facilitated for the looper. The displacement of the blade, especially the descent to the shifted section can cause damages to the fabrics to be sewn when retracting the needle. The cross-sectional surface area of the needle in the section of the scarf is the same or only slightly smaller than the cross-sectional surface area of the blade apart from the scarf. Similar solutions with the same differences to the actual invention are disclosed in U.S. Pat. No. 4,458,614A and EP1052323A2.

SUMMARY

The objective of the present invention is to provide a sewing machine needle that is functionally more reliable during sewing without damaging the fabrics. Moreover a method for the reasonable manufacture of a sewing machine needle is provided. A sewing method less susceptible to faults constitutes additional subject matter of the present invention.

The objective is established by a sewing machine needle, a method for the manufacture of a sewing machine needle and a sewing method as described herein.

At one of its two ends, the sewing machine needle of the invention generally features a longitudinal needle shank with which the sewing machine needle is clamped in a sewing machine. The central axis of the shank, which is, as a rule, cylindrical, defines the central axis of the sewing machine needle. The other end of the sewing machine needle features an integrally moulded longitudinal point, with which, during sewing, the needle pierces the material to be sewn. The eye with the sewing thread threaded through it is immediately adjacent to the point. The blade, which makes up a large part of the sewing machine needle's length, extends between the eye and the shank. Transition areas may exist between each of the aforementioned needle sections.

The eye passes through the needle substantially in a direction referred to as the elevational direction. The elevational direction is perpendicular to the sewing machine needle's longitudinal direction. The longitudinal direction is the direction from the shank at the rear end of the sewing machine needle to the point at the front end of the needle. The longitudinal direction is generally parallel to the central axis. The direction perpendicular to the two aforementioned directions is referred to as the lateral direction.

Behind the eye, a longitudinal scarf extends in the blade portion of the needle. Elevationally, the scarf contour is recessed in comparison with that of the blade. I.e. from the centre of the needle outwards, beyond the scarf, the values of the elevational direction raise. Once the sewing machine needle has pierced the fabric during sewing, the sewing thread is picked up in the scarf area by a looper and held on this side of the fabric during the needle's return stroke. The sewing machine needle has a scarf so that the looper can pick up the thread more reliably. The term scarf refers to a recessed portion in a sewing machine needle. It is configured to create a looping space for a looper, in which the sewing thread is not directly in contact with the needle thanks to the existence of adjacent areas on the blade and eye which are higher than the scarf. The scarf extends from the immediate vicinity of the eye over a portion of the length of the blade.

The maximum elevational reach of the needle contour in the scarf area may preferably be 65% of the maximum lateral reach of the needle contour in the scarf area. The maximum height of the needle may be measured between two parallels to the lateral direction if the first one touches the two groove edges tangentially and the second one makes tangential contact with the scarf. The maximum height of the needle in the scarf may be between 60% and 70% of its maximum breadth in the scarf. The maximum height of the needle in the scarf preferably is between 55% and 75% of its maximum breadth in the scarf. This scarf geometry causes the needle to deflect in the event of a collision with the looper, preventing damage to the needle or even breakage.

The cross-sectional surface area of the needle in the longitudinally oriented scarf area of the sewing machine needle may be 70% of the smallest cross-sectional surface area, perpendicular to the longitudinal direction, of the rest of the blade. The cross-sectional surface area in the scarf may be between 65% and 75% of the cross-sectional area of the rest of the blade. The cross-sectional surface area in the scarf preferably is between 60% and 80% of the cross-sectional area of the rest of the blade. The requirements concerning the needle's strength and the requirements in respect of its geometry, which are necessary for a reliable sewing process and to protect the material being sewn, can be coordinated and optimised by the appropriate choice of cross-sectional surface area in the scarf area. Advantageously the geometry of the scarf is chosen that the width of the scarf is equal to the width of the adjacent blade. Such width provides sufficient strength for the needle. A major width could damage the fabrics to be sewn. By decreasing the cross-sectional surface area on the one hand the scarf can be smaller in its elevational reach compared to its lateral reach and a radius can be chosen to make the needle functionally more reliable during sewing. On the other hand, by reducing the cross-sectional surface area there is no need to shift the scarf towards the longitudinal groove compared to the rest of the blade. Thus, the needle is not damaging the fabrics to be sewn.

The needle according to the invention may have a constant cross-sectional surface area over portions of the blade's length or it may narrow, at least section-wise, towards the point. A narrowing of this kind may be executed such that the contour maintains its shape and is only scaled down continuously by a factor over the course of the blades length. A narrowing section may be present in the scarf area and/or in the rest of the blade. In the event that both the blade and the scarf narrow towards the front, it is advantageous for the maximum cross-sectional surface area of the scarf, at its end nearest the rest of the blade, to be 65% of the smallest cross-sectional surface area of the blade at its end nearest the scarf.

The needle's maximum lateral reach in the scarf area may substantially match its maximum lateral reach in the rest of the blade. By virtue of having a scarf and blade of matching widths, the needle has the necessary strength in the scarf for the sewing process. The other advantage is that the needle hole is not enlarged more than necessary in the scarf, thereby imparting the maximum possible protection to the fabric. If both the blade and the scarf taper towards the front, the smallest blade width, at the end of the blade nearest the scarf, and the largest scarf width, at the end of the scarf nearest the rest of the blade, will match.

In the scarf area, in a sectional plane perpendicular to the longitudinal direction—that is, in all sectional planes in the scarf area except for transition areas—the contour of the sewing machine needle on the scarf's side is substantially an arc of a circle. In particular, no straight, flat sections exist that border directly on a symmetry axis running elevationally in the sectional plane through the needle's central axis. Instead, a contour which is at least approximately an arc of a circle starts from the centre of the scarf and extends both ways in the lateral direction. In this sectional plane, therefore, at least no pronounced plateau forms at the location furthest elevationally from the needle's central axis. This is the meaning of the expression "shaped substantially as an arc of a circle" as used in this publication. Deviations from the circular shape are in as far permissible as these deviations, their purpose being the observance of height- and breadth-related geometrical conditions necessary for the sewing process, do not result in the occurrence of kinks or sharp edges in the scarf.

The circular-arc-shaped area of the scarf's contour covers a first angular portion of the needle's circumference. The first angular portion preferably extends on both sides of a symmetry axis defined in the sectional plane by the central axis of the sewing machine needle and the elevational direction. Additional angular portions that complete the scarf contour may join onto this first angular portion. The scarf contour, or the angular sum of the angular portions making up the scarf contour, altogether covers half, i.e. 180°, of the entire needle circumference. The vertex of the angular portions is determined by the intersection of the symmetry axis, which lies in the elevational direction, with a line running laterally at the position where, in the scarf portion, the needle has its maximum lateral reach.

The roundness radius of the substantially circular-arc-shaped needle contour in the scarf area is preferably approx. 50% of the needle's maximum lateral reach in the scarf area and, more preferably, between 35% and 100% of the needle's maximum lateral reach in the scarf area. The radius may be between 40% and 80% or also between 45% and 60% of the needle's maximum lateral reach in the scarf area. This special choice of roundness radius makes for a scarf shape that is particularly well suited for reliable pick-up of the sewing thread by a looper. For sewing, loopers are generally adjusted in such a way that the sewing machine needle and the looper do not touch each other. During the sewing machine needle's return stroke the sewing thread forms a loop which the looper, interacting with the scarf, picks up. In so doing, the looper carries out a movement, at least intermittently, which also contains components in the lateral direction of the sewing machine needle and with which the looper also approaches the sewing machine needle laterally. Vibrations in the sewing machine, high thread tension, poor sewing-machine settings or other deficiencies, for example, can cause the sewing machine needle and the looper to touch each other. If the scarf is at a uniform elevational level, meaning that the sewing machine needle automatically has a scarf with a plateau, the looper will bang bluntly in such a case against a lateral sewing-machine-needle surface which is at least approximately perpendicular to the looper's direction of movement. In addition to sewing flaws, an impact of this kind can also damage the sewing machine needle and/or the looper. Thanks to the scarf contour according to the invention, the sewing machine needle provides the looper, for the event of possible contact, with angled surface areas in its scarf area, which preferably deflect the looper in the right direction and prevent a blunt impact. In this way the sewing machine needle is functionally more reliable during sewing.

The substantially circular-arc-shaped contour of the needle in the scarf area may extend at least over an angular portion of 90°. The radius may cover an angular portion of at least 100°. The radius may cover an angular portion of at least 110°. Covering a relatively large angular portion ensures that the scarf surfaces angled favourably for the looper offer sufficient reserve for the looper to engage. The available space on the needle is thus exploited optimally.

The needle may preferably attain its maximum lateral reach in the scarf area beneath a central axis, in particular at 32% of its maximum elevational reach as measured from the side facing away from the scarf. The needle may reach its maximum width at between 30% and 35% of its height. The needle may reach its maximum width at between 25% and 40% of its height. Thanks to this measure, the lateral surfaces onto which a looper might impact at an unfavourable angle are reduced to the greatest possible extent.

The blade has a longitudinal groove extending substantially in the needle's longitudinal direction. The scarf and the longitudinal groove are on opposite sides of the blade in the elevational direction. The longitudinal groove preferably extends substantially over the entire length of the blade, from the transition to the shank through to the eye. Over its entire length and particularly in the scarf area, the longitudinal groove advantageously runs substantially parallel to and at a constant distance from the central axis of the sewing machine needle. This configuration again helps to protect the fabric. Longitudinal grooves serve to protect the sewing thread when the fabric is pierced. In principle, this function is also fulfilled by longitudinal grooves which have varying distances from the central axis along their length. However, longitudinal grooves of this kind then have transitional areas between the lengths of groove lying at different heights, and these transitional areas can damage the fabric during piercing or also during the return stroke. In so far, the groove is to be configured, substantially parallel and at a constant distance from the central axis, in such a manner that, in the scarf area, the groove edges may be lowered slightly inwards. This may apply in the same way to the groove floor. In the scarf area, the groove floor may also be slightly raised compared with the groove floor in the rest of the blade. The deviation of the groove, that is, of the groove edges and/or of the groove floor, from central-axis parallelism, or the deviation in the distance of the groove edges and/or groove floor from the central axis in the scarf area compared to the rest of the blade is then a maximum of 10% of a mean blade width. The deviation of the groove from parallelism, or the deviation in the distance of the groove from the central axis, may not exceed 5% of a mean blade width. The deviation of the groove from parallelism, or the deviation in the distance of the groove from the central axis, may not exceed 2% of a mean blade width.

The blade may have a groove running lengthwise and following on from the scarf. This groove is often referred to as the short groove. In the elevational direction, it runs on the opposite side to the longitudinal groove. The short groove may reach from the scarf to the shank. It is also possible for an area that is raised in comparison with the scarf to exist between the scarf and the short groove. As described earlier on, the purpose of a raised area of this kind is to enable the looper to pick up the thread easily in the scarf. All sewing-needle embodiments according to the invention may have a short groove of this kind.

The needle's contour in the scarf area, seen in a cross sectional view obtained by cutting through the needle at right angles to its length, may have, in addition to the first angular portion, at least a second angular portion, which runs in a straight line, and a third angular portion connecting the first and second angular portions. The third portion forms a kink-free connection between the other two portions. The straight portion is preferably short and preferably exists on both sides in the lateral direction. The straight portion may be at an angle of 18° to the elevational direction. The straight portion may be at an angle of 15° to 21° to the elevational direction. The straight portion may be at an angle of 12° to 24° to the elevational direction. The third angular portion guides the roundness radius of the first angular portion tangentially, with no kinks, into the straight part of the second angular portion. At least the contour of the third angular portion, i.e. the transition between the first and second angular portions, is angled in such a way relative to a potentially impacting looper as to enable damage-free continuation of the sewing process despite contact between the two parts. In a further advantageous embodiment, the angle of the straight portion, which, in the scarf area, covers the second angular portion, may be changeable further along the blade area. For example, the angle may increase from 30° to 36° in the direction of the shank. The angle may also increase by another amount. Likewise, the angle of the blade where it adjoins the scarf may have a value other than 30°, this depending on how the scarf is configured.

In the area in which the scarf extends along the length of the needle, the sewing machine needle may, in the sectional plane perpendicular to the longitudinal direction, be configured mirror symmetric about a symmetry axis defined by the elevational direction and the central axis. By virtue of this symmetry, the sewing machine needle can be used both in sewing machines in which the looper hooks into the scarf from the left side and in sewing machines in which it hooks in from the right side of the needle. The needle can likewise be used in machines or for applications in which a bevel is required in the scarf. The contour of the scarf in the sewing machine needle according to the invention renders an additional bevel in the scarf unnecessary. In conjunction with the symmetry, this applies to every bevel, irrespective of which side of the scarf it might be needed. The symmetry may advantageously apply to the longitudinal groove, too. The centre of the longitudinal groove will then lie on the symmetry axis in just the same way as the point on the scarf contours circular arc at which a parallel to the lateral direction makes tangential contact. Likewise, it is preferable for all first, second and third angular portions to be arranged in mirror symmetry.

The method for the manufacture of a sewing machine needle according to the invention comprises at least a first step of decreasing the cross-sectional surface area of the blade in a part of the longitudinal extension of the blade. In a at least second step the blade is chipless deformed for at least forming a scarf. The method is characterised in that the step of forming the scarf is conducted in such way that the scarf is formed with a radius of curvature being between 35% and 100% of the maximum reach of the scarf in the lateral direction. Further steps forming the blade are not required. The chipless formed geometry of the blade can be slightly rounded in following steps if for example burrs or roughnesses on other parts of the needle generated in following steps have to be worked on and the blade is affected also.

The step of decreasing the cross-sectional surface area of a part of the blade can be done without removing material from the needle. In this way, there is no waste to dispose. As a further advantage only the amount of material as required for a needle has to be used. In consequence, the method of manufacture a sewing machine needle is economic. The step of decreasing the cross-sectional surface area can be a cutting operation. Such operations require short machining times and are economic therefore. The step of decreasing the cross-sectional surface area can be done by removing material using tools without defined cutting edges. Such operations are very precise. Further different operations with deforming and/or removing material can be used advantageously.

The step of decreasing the cross-sectional surface area of a part of the blade can strengthen the remaining material of the needle. This is especially advantageous as the scarf is formed in this part of the blade in a following step. The scarf is subjected to high loads during sewing and thus high strength is recommended in the longitudinal extension of the scarf. Hence, it is possible to manufacture a needle with a decreased cross-sectional surface area in the scarf in order that the needle not damages the fabrics to be sewn and at the same time with sufficient strength in order that the needle not breaks or bends permanently due to the loads during sewing.

At least one sewing needle and at least one looper are used in the sewing process according to the invention. The sewing needle has the following features: a blade, which extends substantially in the needle's longitudinal direction;

an eye, which passes through the needle substantially in its elevational direction, the elevational direction of the needle being perpendicular to its longitudinal direction; a scarf, which extends along the needle behind the eye and whose contour is recessed elevationally in comparison with the blade contour. At least in part of the scarf's extension along the needle, the scarf contour in a sectional plane perpendicular to the needle's longitudinal direction is substantially an arc of a circle. The circular-arc-shaped area covers a first angular portion of the needle's circumference.

During routine operation, the looper picks up the thread loop as part of a hooking motion during which it reaches past the extended needle. The looper picks up the thread loop in the scarf area of the needle. In so doing the looper may perform rotational or slewing movements. Every type of movement performed by the looper has components in a direction that corresponds with the lateral direction of the sewing machine needle.

In the case of operational deflections of the needle, the looper collides with the needle in the first angular portion of the contour of the scarf of the needle. In the sewing process according to the invention, use is made of a needle which, in this first angular section, has a contour with a radius of curvature that is between 35% and 100% of the needle's maximum reach in the lateral direction. The needle's lateral direction is perpendicular to its longitudinal and elevational directions. Thanks to use of a needle of such kind in the method according to the invention, the sewing process is less susceptible to problems because, in the event of a malfunction and a consequential needle-looper collision, the needle and the looper can slide past each other suitably, allowing the sewing process to be continued without interruption. The looper may also collide with the needle in the other angular sections of the scarf contour. At least also in the third angular section, the contour of the scarf of the needle is angled in such a way relative to the lateral direction as to enable continuation of the sewing process despite a collision between looper and needle.

DETAILED DESCRIPTION

Figure 1:
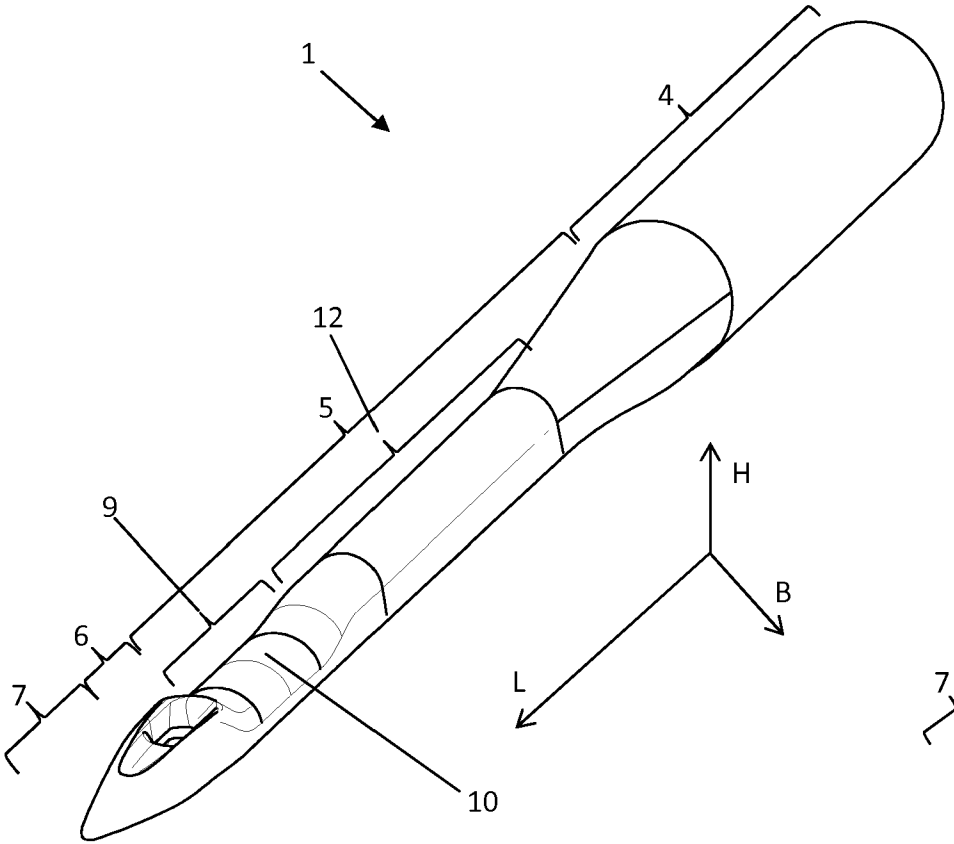
FIG. 1 shows a simplified oblique view of the scarf of a sewing machine needle according to the invention

FIG. 1 shows a simplified oblique view of the scarf 10 of a sewing machine needle 1 according to the invention. The sewing machine needle 1 extends in the longitudinal direction L from a shank 4 at one end through the blade 5 and the eye 6 to the point 7. The portion 9 of the scarf 10, said portion extending from the immediate vicinity of the eye 6 over part of the length of the blade 5, is also shown. The remaining portion 12 of the blade 5 is indicated too. The contour 11 of the needle in a sectional plane through the portion 9 of the scarf 10, perpendicular to the longitudinal direction L, is roughly recognizable. The longitudinal direction L, the lateral direction B and the elevational direction H have been added for purposes of orientation.

Figure 2:
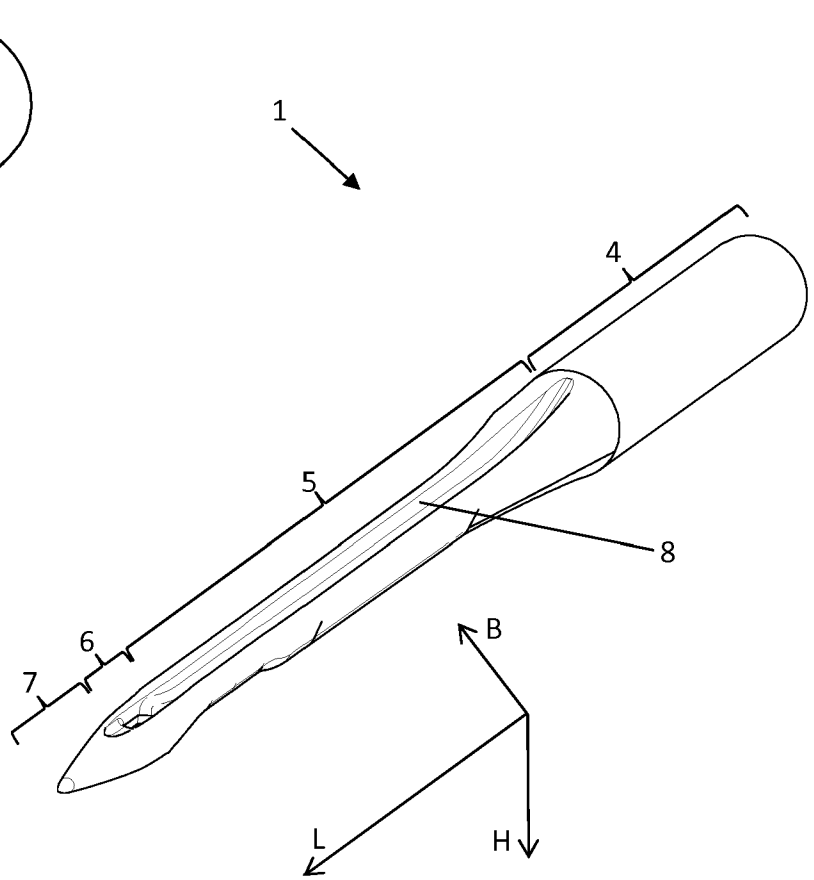
FIG. 2 shows a simplified oblique view of the longitudinal groove of a sewing machine needle according to the invention

FIG. 2 shows a simplified oblique view of the longitudinal groove 8 of the sewing machine needle 1 according to the invention. Except for the scarf 10, the individual sections along the length of the sewing machine needle 1 are shown here as well. It is particularly evident that the longitudinal groove 8 and the edges thereof, which protect the sewing thread (not shown) during sewing, is straight and has no steps.

Figure 3:
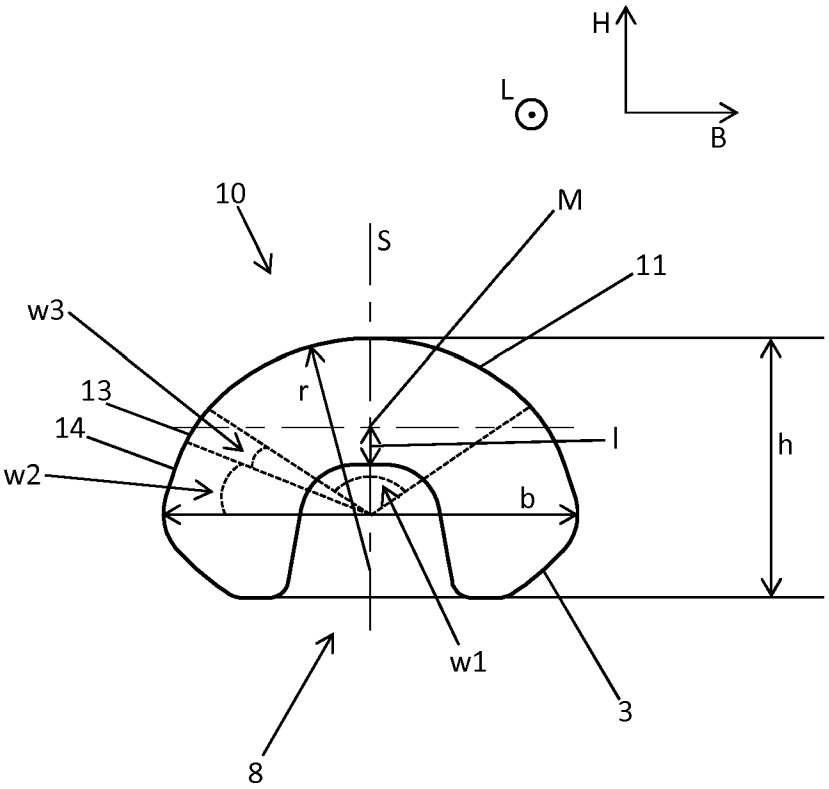
FIG. 3 shows a sectional view of the contour of the sewing machine needle according to the invention in the scarf

FIG. 3 shows a sectional view of the contour 11 of the sewing machine needle 1 according to the invention in the scarf of FIG. 1. The section can have been cut at any arbitrary point in the portion 9 of the scarf 10 except for the transition areas between the portion 9 of the scarf 10 and the eye 6 and between the portion 9 of the scarf 10 and the remaining area 12 of the blade 5. In this view, the scarf 10 is at the top and the longitudinal groove 8 at the bottom. The roundness radius r is shown as an arrow line. The angular portions w1, w2 and w3 are indicated with dashed lines. A coordinate system showing the lateral direction B and the elevational direction H has been added for clarification. The longitudinal direction L is perpendicular to the plane of the drawing. Within the contour and parallel to the lateral direction B, the maximum reach b of the sewing machine needle 1 in the portion 9 of the scarf 10 is identifiable. In this drawing, the central axis M runs perpendicular the plane of the drawing and is defined by the intersection of the two discontinuous lines, of which the one parallel to the elevational direction H is labelled with the reference numeral S. In the portion 9 of the scarf 10, the contour 11 of the sewing machine needle 1 is mirror symmetric about the symmetry axis S. The vertex of the angular portions w1, w2 and w3 is the intersection of the symmetry axis S with the line parallel to the lateral direction B, on which the needle has its maximum lateral reach b. The distance I between the longitudinal groove 8 and the central axis M is shown by an arrow. A transition 13 and a straight portion 14 are shown on the left side of the contour 11. The transition 13 connects the straight section 14 in kink-free manner with the substantially circular-arc-shaped contour of the first angular portion w1.

Figure 4:
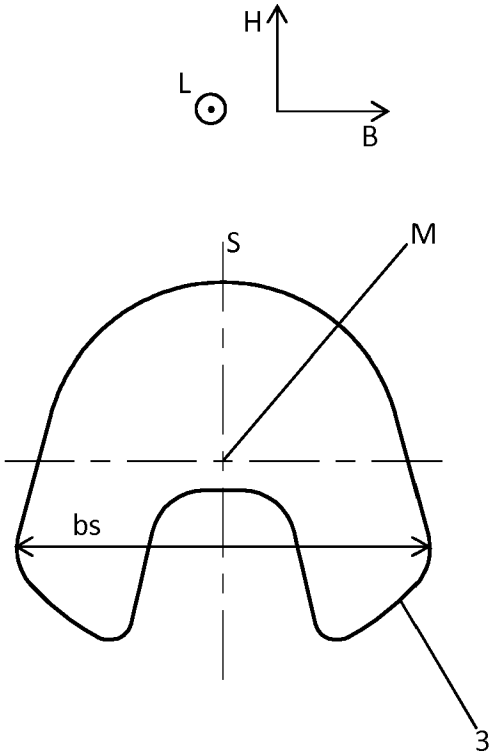
FIG. 4 shows a sectional view of the contour of the sewing machine needle according to the invention in the blade

FIG. 4 shows a sectional view of the contour of the sewing machine needle 1 according to the invention in the blade 5. This contour, too, may be obtained anywhere along the blade 5 except for the transition areas, where it deviates. The coordinate system with the lateral direction B and the elevational direction H has again been added for orientation purposes. Here too, the contour is mirror symmetric about the axis S, which runs through the central axis M and parallel to the elevational direction H. The maximum lateral reach bs of the sewing machine needle 1 in the remaining area 12 of the blade 5 is shown. This corresponds to the maximum reach b, in the lateral direction B, of the sewing machine needle 1 in the portion 9 of the scarf 10 of FIG. 3. The maximum reach bs may deviate from the maximum reach b if, for example, the needle is of tapered design.

List of reference numerals

| | |
|---|---|
| 1 | Sewing machine needle |
| 3 | Needle circumference |
| 4 | Shank |
| 5 | Blade |
| 6 | Eye |
| 7 | Point |
| 8 | Longitudinal groove |
| 9 | Portion of scarf |
| 10 | Scarf |
| 11 | Contour |
| 12 | Remaining area of blade |
| 13 | Transition |
| 14 | Straight portion |
| b | Maximum reach, in the lateral direction B, of the sewing machine needle 1 in the portion 9 of the scarf 10 |
| bs | Maximum reach, in the lateral direction B, of the sewing machine needle 1 in the remaining area 12 of the blade 5 |
| h | Maximum reach, in the elevation al direction H, of the sewing machine needle 1 in the portion 9 of the scarf 10 |
| l | Distance between the longitudinal groove 8 and the central axis M |

-continued

| List of reference numerals | |
|---|---|
| r | Roundness radius |
| w1 | First angular portion |
| w2 | Second angular portion |
| w3 | Third angular portion |
| B | Lateral direction |
| H | Elevational direction |
| L | Longitudinal direction |
| M | Central axis |
| S | Symmetry axis |

What is claimed is:

1. Sewing machine needle (1) comprising:

a blade (5), which extends substantially in a longitudinal direction (L) of the needle (1), an eye (6), which passes through the needle (1) substantially in an elevational direction (H) of the needle, the elevational direction (H) of the needle (1) being perpendicular to the longitudinal direction (L);

a scarf (10), which precedes the eye (6) in the longitudinal direction (L) of the needle (1), the scarf's (10) having a contour (11) recessed in the elevational direction (H) of the needle (1) in comparison with a contour of the blade (5), wherein a maximum cross-sectional area of the needle (1) in a portion (9) of the scarf (10) along a longitudinal extension of the needle (1) is between 60% and 80% of a smallest cross-sectional area, measured perpendicular to the longitudinal direction (L) of the needle (1), in an area over which a remainder of the blade (12) extends longitudinally and wherein, in the portion (9) of the scarf (10), the needle (1) has a maximum reach (h) in the elevational direction (H) that is between 55% and 75% of a maximum reach (b) of the needle (1) in a lateral direction (B) in the portion (9) of the scarf (10), and wherein, at least in a section of the scarf's (10) extension in the longitudinal direction (L) of the needle (1), the contour (11) of the scarf (10) in a sectional plane through the portion (9) of the scarf (10) perpendicular to the longitudinal direction (L) of the needle (1) is configured to be shaped substantially as an arc of a circle, wherein the circular-arc-shaped section covers a first angular portion (wl) of a circumference (3) of the needle (1), wherein:

a radius (r) of the contour in the first angular portion (wl) of the circumference (3) in the section of the scarf's (10) extension in the longitudinal direction (L) of the needle (1) is between 45% and 60% of the maximum reach (b) of the needle (1) in the lateral direction (B), the lateral direction (B) being perpendicular to the longitudinal (L) and elevational (H) directions of the needle (1).

2. Sewing machine needle (1) according to claim 1, wherein in the sectional plane through the portion (9) of the scarf (10), the circular-arc-shaped contour (11) of the needle (1) covers the first angular portion (w1) of at least 90°.

3. Sewing machine needle (1) according to claim 1, wherein in the portion (9) of the scarf's (10) extension in the longitudinal direction (L) of the needle (1), the needle (1) attains the maximum reach (b) in the lateral direction (B) beneath a central axis (M) at a location between 25% and 40% of the maximum reach (h) in the elevational direction (H), as measured from a side facing away from the scarf (10).

4. Sewing machine needle (1) according claim 1, wherein in the portion (9) of the scarf (10), the maximum reach of the needle (1) in the lateral direction (B) corresponds substantially to a minimum of a maximum reach (bs) of the needle (1) in the lateral direction (B) in the remainder of the needle blade (12).

5. Sewing machine needle (1) according to claim 1, wherein the needle (1) has a longitudinal groove (8), which extends in the longitudinal direction (L) of the needle (1) and which is located on a side of the needle (1) facing away from the scarf (10).

6. Sewing machine needle (1) according to claim 5, wherein the longitudinal groove (8) runs substantially parallel to and at a constant distance from a central axis (M) of the needle (1) over an entire extension in the longitudinal direction (L) and in the scarf (10).

7. Sewing machine needle (1) according to claim 1, wherein in the section (9) of the scarf's longitudinal extension, the contour (11) of the needle (1), seen in a cross-sectional view obtained by cutting through the needle (1) at right angles to the longitudinal extension (L) of the needle (1), has, in addition to the first angular portion (w1), at least a second angular portion (w2), which runs in a straight line, and that a third angular portion (w3) connects the first angular portion (w1) and the second angular portion (w2), said third angular portion (w3) forming a kink-free connection between the first angular portion (w1) and the second angular portion (w2).

8. Sewing machine needle (1) according claim 1, wherein in the portion in which the scarf (10) extends in the longitudinal direction (L) of the needle (1), in a sectional plane perpendicular to the longitudinal direction (L), the sewing machine needle (1) is configured mirror-symmetric about a symmetry axis (S) defined by the elevational direction (H) and a central axis (M) of the needle (1).

9. Method of producing the needle (1) according to claim 1, the method comprising:

reducing a cross-sectional area of the blade (5) in a section thereof, and deforming the blade (5) without cutting action for providing at the scarf (10).

10. Method of producing the needle (1) according to claim 9, further comprising reducing the cross-sectional area without removing any material.

11. Method of producing the needle (1) according to claim 9, further comprising work-hardening residual material of the needle (1) during the reducing of the cross-sectional area.

* * * * *